United States Patent [19]

Takahashi

[11] 4,238,880

[45] Dec. 16, 1980

[54] ASSEMBLING APPARATUS FOR SLIDE FASTENER STRINGERS

[75] Inventor: Kihei Takahashi, Uozu, Japan

[73] Assignee: Yoshida Kogyo K.K., Japan

[21] Appl. No.: 968,801

[22] Filed: Dec. 12, 1978

[30] Foreign Application Priority Data

Dec. 15, 1977 [JP] Japan ..... 52/151125

[51] Int. Cl.[3] ..... B23P 19/04

[52] U.S. Cl. ..... 29/766

[58] Field of Search ..... 29/33.2, 408, 410, 766, 29/771, 779, 819

[56] References Cited

U.S. PATENT DOCUMENTS

| | | | |
|---|---|---|---|
| 2,219,165 | 10/1940 | Nedal | 29/408 |
| 2,613,433 | 10/1952 | Rojahn | 29/766 |
| 3,947,946 | 4/1976 | Omori et al. | 29/408 |
| 3,955,263 | 5/1976 | Gauthier | 29/766 X |

*Primary Examiner*—Ervin M. Combs

*Attorney, Agent, or Firm*—Hill, Van Santen, Steadman, Chiara & Simpson

[57] ABSTRACT

In an assembling apparatus for slide fastener stringers with spaced sections, the leading element of the element row in the leading stringer is detected by a probe inserted into the guide groove of the binder member for the elements and the engagement of the leading element and the claw of the probe retards the progress of the leading stringer leading to the retardation of the rotation of the pulling roller for the leading stringer as a consequence while the rotation of the other pulling roller for the trailing stringer, which is connected to the first pulling roller through a differential transmission mechanism is accelerated whereby the trailing stringer is forwarded with increased velocity to rapidly catch up with the leading stringer so that both of the stringers are brought into right alignment to be exactly interengaged in the binder member without mismatching.

4 Claims, 8 Drawing Figures

ASSEMBLING APPARATUS FOR SLIDE FASTENER STRINGERS

BACKGROUND OF THE INVENTION

The present invention relates to an assembling apparatus for slide fastener stringers used in forming a slide fastener chain by combining a pair of slide fastener stringers to be interengaged with each other at the individual interengagement elements thereof.

The prior art assembling apparatuses for such a purpose are provided with a pair of pulling rollers rotating coaxially at the same velocity and positioned close to each other, a binder member with a structure in its main part similar to that of a slider in a finished slide fastener positioned at the feeding side of the above mentioned pulling rollers and stoppers positioned before the entrance to the binder member which serve to align the starting terminals of the rows of the elements of both of the slide fastener stringers (see, for example German Patent Publication No. DE-AS 1225432).

Each of the slide fastener stringers fed to the apparatus is shaped in a continuous length, having space sections each of a predetermined length at predetermined intervals, and a right fastener stringer and a left fastener stringer are combined in the binder member into a slide fastener chain of interengaged stringers, being introduced into the binder member with the rows of the elements facing each other, after the leading elements of the rows of the elements of both of the fastener stringers have been brought into alignment, and the alignment being maintained as such, and the interengaged slide fastener chain being discharged from the binder member continuously by the pulling rollers.

In the alignment of the slide fastener stringers as above in conventional apparatuses, the progress of the leading fastener stringer (if one is ahead of the other) is interrupted by a stopper at its respective side for a while during which the trailing slide fastener stringer is forwarded to catch it up and, when both of the leading elements come into contact with the individual stoppers, the stoppers are moved aside to permit the progress of both of the fastener stringers.

The problems in the prior art apparatuses are that the once aligned stringers often come to be out of alignment before they are combined completely, causing mismatching of the elements because the alignment is performed before the stringers enter the binder member, and that some of the elements are displaced from their right positions where they have been secured to the carrier tapes because of the large impact force exerted on the elements of the leading stringer by the interruption of its progress at the stopper resulting in decreased reliability of the assembling process. Further, the productivity in the prior art apparatuses cannot be sufficiently high because an increased feeding velocity of the stringers results in an increased impact force to the elements coming into contact with the stopper to limit the feeding velocity as well as because quite a long time is taken for alignment of the leading elements of leading and trailing fastener stringers to limit the overall velocity of the apparatus.

SUMMARY OF THE INVENTION

It is therefore an object of the present invention to provide a reliable and efficient assembling apparatus for slide fastener stringers, with which a pair of fastener stringers can be brought into interengagement reliably without mismatching into a slide fastener chain and the assembling apparatus of the invention is so constructed as to be able to forward the trailing stringer at a larger velocity than the leading stringer when both of the stringers are running one ahead of the other so as that the alignment of the leading elements of the rows of elements to be brought into interengagement can be rapidly achieved.

The assembling apparatus of the present invention is characterized in the structure in which a means for detecting the leading elements of the rows of elements in the running fastener stringers is provided whereby a resisting force to retard the running velocity of the stringer is provided with which the rotation of the pulling roller is retarded corresponding to the resisting force while the rotation of the other roller is accelerated, the detection of the leading elements and the resisting force being effected by a pair of probes at the binder member and the difference between the rotating velocities of both pulling rollers being obtained by a differential transmission mechanism.

DETAILED DESCRIPTION OF THE PREFERRED EMBODIMENTS

In the following, the apparatus of the present invention is illustrated by way of examples with reference to the drawings annexed.

Figure 1:
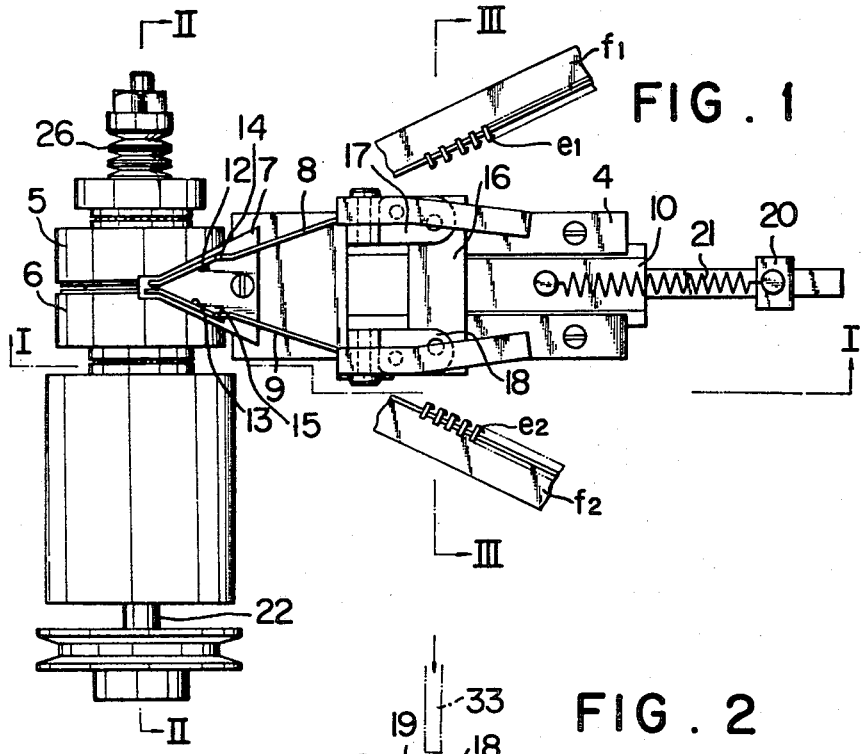
FIG. 1 is a plan view of a preferred assembling apparatus for slide fastener stringers in accordance with the present invention.
Figure 2:
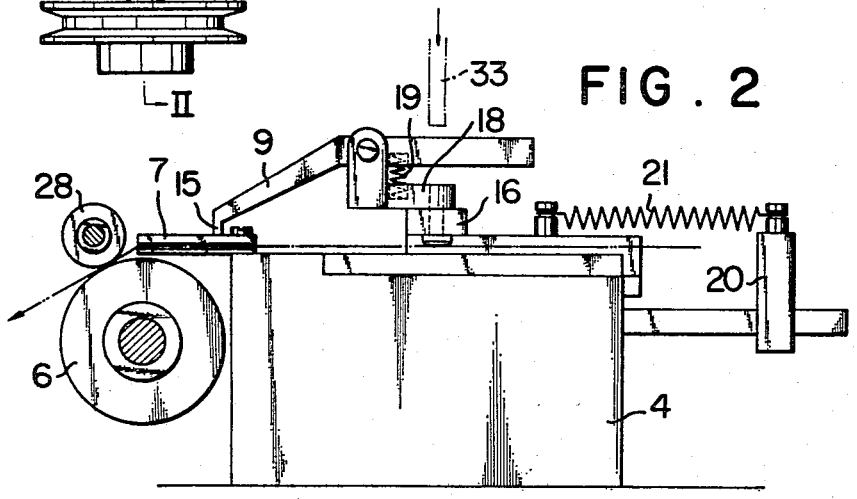
FIG. 2 is a cross sectional view of the same apparatus along the line I—I in FIG. 1 as viewed in the direction of the arrows.

In FIGS. 1 and 2, a pair of pulling rollers 5 and 6 are provided in proximity to each other at an advanced position of a frame 4 and a binder member 7 in a form of something like a triangle is positioned at the feeding side of these pulling rollers 5 and 6 protrudently at the end of the frame 4. A slider member 10 is provided on the frame 4 capable of sliding forwardly and backwardly in the direction of the binder member 7 on the frame 4 and the slider member 10 also serves as a support for probes 8 and 9. The structure of the binder member 7 is similar in principle to that of a slider in a finished slide fastener being constructed with integrally combined upper piece and lower piece with a Y-shaped guide groove 11 (see FIGS. 6 and 7) for the element rows. The upper piece of the binder member 7 is provided with guide apertures 12 and 13 along the guide groove 11 each over a length from the entrance to the binder member 7 to the position where the interengagement of the elements $e_1$ and $e_2$ has been completed, with which the probes 8 and 9 are guided along the guide groove 11. One of the guide apertures 13 is longer than the other 12 as extended at the end by a half of the pitch of the elements in each of the fastener stringers. Claws 14 and 15 extending downwardly at the ends of the probes 8 and 9 are inserted into the guide apertures 12 and 13, respectively, and the points of the claws 14 and 15 are located in the guide groove 11. The probes 8 and 9 are supported pivotally for pivotal movement in vertical planes at the upper ends of brackets each standing at the ends of respective arms 17 and 18, which in turn are supported pivotally at the ends of a base plate 16 fixed to the slider member 10 at a right angle and which are rotatable in a horizontal plane around the pivots at the ends of base plate 16. Each of the probes 8 and 9 is connected to the respective arm 17 or 18 with a compression spring 19 at the opposite side to the claw 14 or 15 so as that the claw 14 or 15 is pushed down into the guide aperture 12 or 13. The slider member 10 is always subject to a pulling force toward a fixed point 20 exerted by a tension spring 21.

Figure 3:
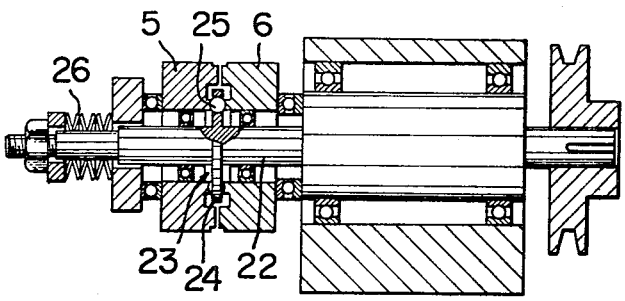
FIG. 3 is a cross sectional view of the same apparatus along the line II—II in FIG. 1 as viewed in the direction of the arrows.
Figure 4:
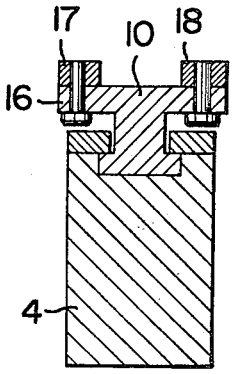
FIG. 4 is a cross sectional view of the same apparatus along the line III—III in FIG. 1 as viewed in the direction of the arrows.
Figure 5:
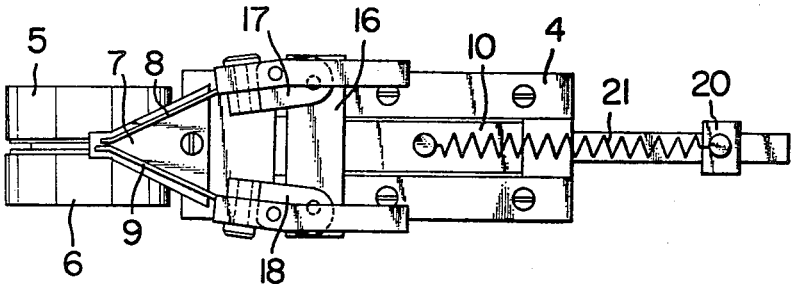
FIG. 5 is a similar plan view to part of FIG. 1, in which the probes are in advanced positions.

The structure of the pulling rollers 5 and 6 is illustrated in FIG. 3, which is a cross sectional view. The rollers 5 and 6 are connected to the driving shaft 22 through a differential transmission mechanism 23. Namely the driving shaft 22 is provided with a brim like disc 24 integrally fixed thereto and the disc 24 is provided at its periphery with a plurality of balls 25 with a diameter larger than the thickness of the disc 24 and rotating freely, seated in recesses in the disc 24. The right and left rollers 5 and 6 are connected to the driving shaft 22 with the disc 24 between them as being in press-contact by the pushing force of a stack of cup springs 26. Each of the pulling rollers 5 and 6 is in contact with a respective subsidiary roller 28 (FIG. 2) at the upper periphery with which the fastener stringers are pulled forwardly.

Figure 8:
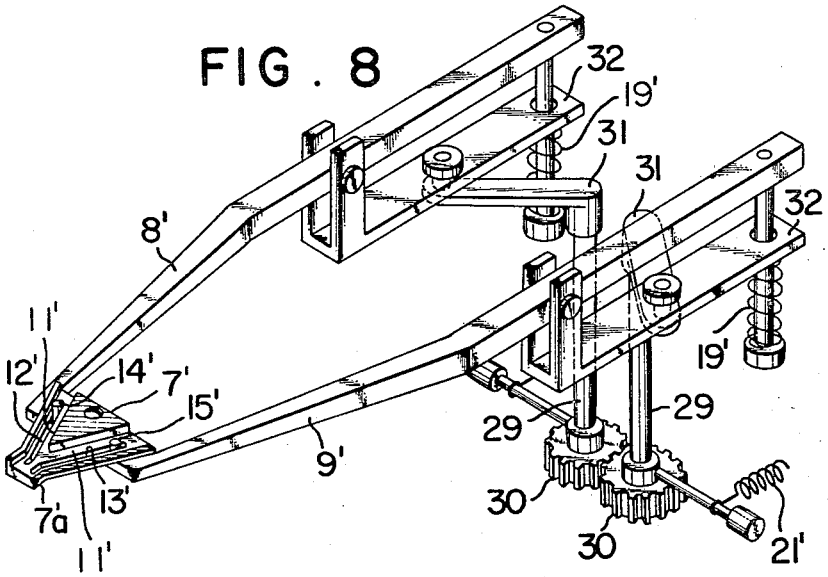
FIG. 8 is a perspective view showing an alternative structure of the probes and the supporting device therefor.

FIG. 8 shows an alternative supporting structure for probes 8' and 9', in which a pair of vertical rods 29, 29 are provided at their lower ends with gears 30, 30 of the same diameter in interengagement with each other and at their upper ends with cranks 31, 31 to the ends of which swaying plates 32, 32 are pivotally connected at the middle portions thereof permitting free rotation. The probes 8' and 9' are supported pivotally to the brackets standing on the swaying plates 32, 32 so as that the claws 14' and 15' at the ends of the probes and pointing upwardly can move up and down whereby the points of the claws 14' and 15' enter or come out of the guide apertures 12' and 13' respectively, at the downside thereof. The probes 8' and 9' are pulled downwardly (relative to plates 32) at the ends opposite to the claws 14' and 15', respectively, by the action of the springs 19', 19' so as that the claws are pushed upwardly into the guide apertures from below. In addition, the vertical rods 29, 29 are subject to rotational moment by virtue of respective strings 21', so that the claws 14' and 15' of the probes 8' and 9' are pulled toward the ends of the guide apertures 12' and 13' near the entrance of the binder member 7'. Further, the lower piece of the binder member 7' is thickened at the front end thereof to form a raised part **7'*a* so that the claws 14' and 15' come readily out of the guide groove 11' by sliding along this raised part 7*a***.

In the apparatus illustrated in FIGS. 1 and 2, the claws 14 and 15 of the probes 8 and 9 come out of the guide groove 11 by pushing down the probes 8 and 9 at the opposite side to the claws by lowering a push rod 33 which is operated by a solenoid or other suitable means.

Figure 6:
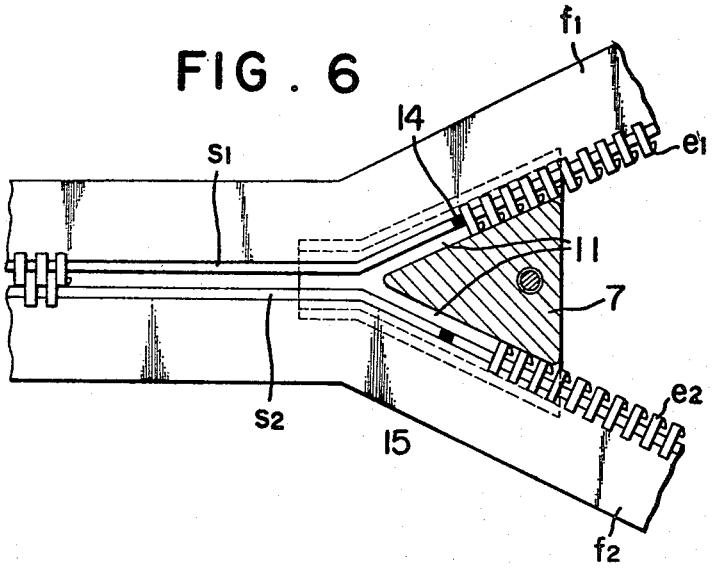
FIG. 6 is a plan view showing the condition of detecting one of the leading elements of the element rows by the probe within the binder member with the upper piece of the binder member removed for illustration.
Figure 7:
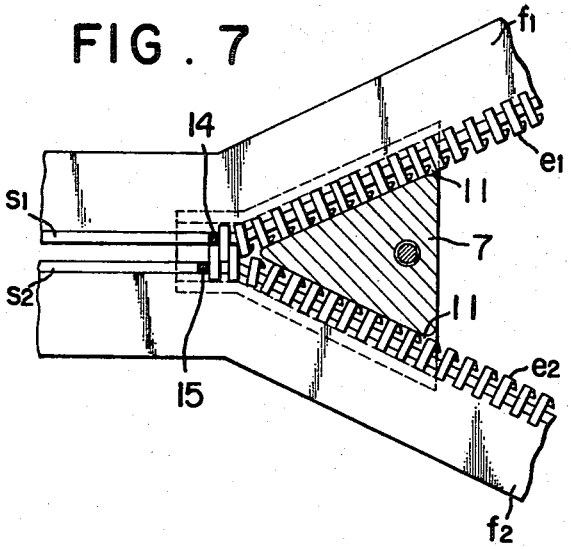
FIG. 7 is a plan view showing the condition of the fastener stringers which have come to an exact interengagement with each other without mismatching within the binder member, the upper piece of the binder being removed for illustration.

The process of assembling slide fastener stringers by use of the apparatus with above structure is described below in detail. When a pair of right and left stringers $f_1$ and $f_2$ are passed through the binder member 7 by being pulled by the pair of right and left pulling rollers 5 and 6, the right and left elements $e_1$ and $e_2$ become interengaged with each other progressively in the binder member 7 to form an assembled slide fastener chain. The stringers have spaced sections $S_1$ and $S_2$ at predetermined intervals and when these spaced sections $S_1$ and $S_2$ enter the binder member 7, the points of the claws 14 and 15 of the probes 8 and 9 become contacted by the individual elements $e_1$ and $e_2$ directly succeeding the space sections $S_1$ and $S_2$ since the claws 14 and 15 are protruding through the guide aperture 12 and 13 within the binder member 7. If the advancing elements $e_1$ and $e_2$ are in right positions of alignment so as that the elements $e_1$ and $e_2$ can be exactly interengaged with each other, the claws 14 and 15 come to contact with the leading ones of the elements $e_1$ and $e_2$ at the same time and thereafter the probes 8 and 9 are forwarded at the same velocity, engaged with the advancing elements $e_1$ and $e_2$, respectively, at the claws 14 and 15. As is shown in FIG. 6, however, when one of the stringers $f_1$ and $f_2$, $f_1$ in FIG. 6, for example, goes in advance of (i.e., leads) the other stringer $f_2$ so that the leading element $e_2$ of the trailing stringer has not yet made contact with the claw 15 when the leading element $e_1$ has already come to contact with the claw 14, then the advancing of the stringer $f_1$ undergoes a backward tension by virtue of the interengagement with the claw 14 of the probe 8, which tension in turn retards the rotational velocity of the corresponding pulling roller 5 and, on the other side, accelerates the rotational velocity of the other pulling roller 6 which is exerting a pulling force to the trailing stringer $f_2$. Thus the advancing velocity of the trailing stringer $f_2$ is increased while the velocity of the leading stringer $f_1$ is decreased so that the leading element $e_2$ of the trailing stringer $f_2$ rapidly comes into contact with the claw 15 of the probe 9 in right alignment with the leading element $e_1$ to be exactly interengaged within the binder member 7. When the claws 14 and 15 arrive at the joining point of the right and left branches of the guide groove 11, the claws 14 and 15 are taken out of the groove 11 by means of the push rod 33 by actuating the solenoid.

As described above, the assembling apparatus of this invention is constructed by providing a pair of probes 8, 9 or 8', 9' which serve to detect the leading elements $e_1$, $e_2$ of the element rows on the right and left fastener stringers $f_1$, and $f_2$, and, at the same time, to retard the progress of the leading stringer in such a manner that the claws 14, 15 or 14', 15' of the probes enter or move out of the guide groove 11 or 11' in the binder member 7 or 7' freely and by providing a differential transmission mechanism 23 between the right and left pulling rollers by virtue of which the retardation of the leading stringer by the corresponding probe directly leads to the retardation of the corresponding pulling roller and, as a consequence, to the acceleration of the other pulling roller to the same extent as the retardation of the first pulling roller so that the mismatched alignment of the right and left stringers is rapidly corrected with the subsequent interengagement of the elements to be performed without mismatching reliably. Further the probe which has come to contact with the leading element on the leading stringer is not stopped at the point of contact but it continues to move along the direction of the advancement of the stringer while exerting a retarding force on the leading stringer so that the element receives little shock by contacting with the claw of the probe and the correction of the alignment of the stringers is performed smoothly and shocklessly with no danger of deformation of the elements or displacement of the elements out of their right positions.

What is claimed is:

1. An assembling apparatus for a pair of fastener stringers each having a row of fastener elements therealong, comprising a pair of pulling rollers rotatably mounted close to each other on a driving shaft with a space therebetween, a pair of auxiliary rollers in contact with the pulling rollers and providing therewith a pair of inlet nips for pulling the respective stringers, and a binder member fixedly position at the inlet nip side of said pulling rollers and having a pair of guide grooves for directing the stringers into the respective nips, characterized in that a pair of probes are each mounted for freely transversely entering or withdrawing from a guide groove in said binder member for the fastener elements, said probes serving to detect leading fastener elements on a leading stringer and to retard the advancement of the leading stringer when the fastener elements thereon come in contact with a respective probe, and a differential transmission mechanism connected between said pulling rollers for retarding one of the pulling rollers which is advancing the leading stringer and simultaneously accelerating the other of the pulling rollers which is advancing the other stringer to longitudinally align mismatched rows of elements on the pair of stringers.

2. The assembling apparatus of claim 1 wherein the differential transmission mechanism comprises a disc drivingly secured to the driving shaft of the pulling rollers, a plurality of balls with diameter larger than the thickness of said disc seated in recesses in said disc for free rotation, the pulling rollers being freely rotatable on the driving shaft and press-contacted with said balls with the disc therebetween.

3. The assembling apparatus of claim 1 or claim 2 wherein the probes each have a claw at one end of the probe entering the guide groove for the elements and wherein the probes pivot around both vertical axes and horizontal axes and are supported on a slider member capable of sliding in the direction toward the pulling rollers and wherein the slider member is connected to a spring exerting a pulling force on the sliding body in the direction away from the pulling rollers.

4. The assembling apparatus of claim 3 wherein a push rod is provided facing each of the probes whereby the claw is freed from the binder member.

* * * * *